US006688905B2

(12) United States Patent
Williams

(10) Patent No.: US 6,688,905 B2
(45) Date of Patent: Feb. 10, 2004

(54) FIELD ATTACHABLE ELECTRICAL CONNECTOR AND SELF-TIGHTENING METHOD OF STRAIN RELIEF

(76) Inventor: Roger Williams, 2024 Pueblo Ct. South, Santa Rosa, CA (US) 95409

( * ) Notice: Subject to any disclaimer, the term of this patent is extended or adjusted under 35 U.S.C. 154(b) by 0 days.

(21) Appl. No.: 09/829,142

(22) Filed: Apr. 9, 2001

(65) Prior Publication Data

US 2002/0146930 A1 Oct. 10, 2002

(51) Int. Cl.[7] ..... H01R 13/58
(52) U.S. Cl. ..... 439/461; 439/696
(58) Field of Search ..... 439/461, 462, 439/321, 170, 459, 199, 936; 74/501.5, 502; 174/86, 87

(56) References Cited

U.S. PATENT DOCUMENTS 4,211,463 A * 7/1980 Chandler ..... 339/103
4,694,706 A * 9/1987 Lichtenberg et al. ..... 74/501.5
4,976,634 A * 12/1990 Green et al. ..... 439/589
5,219,304 A * 6/1993 Lin ..... 439/461
5,941,718 A * 8/1999 Didier ..... 439/170
6,007,384 A * 12/1999 Kraemer et al.
6,132,250 A * 10/2000 Shinozaki et al. ..... 439/587

* cited by examiner

*Primary Examiner*—Alexander Gilman
(74) *Attorney, Agent, or Firm*—Risto A. Rinne, Jr.

(57) ABSTRACT

An apparatus for connecting a plurality of conductors in a cable to a corresponding mating includes a plurality of crimp contacts, a plastic nose insert, an elastomeric nose and a pair of plastic body housings that attach together in a clamshell fashion and in which the conductors are contained and attached. A strain relief assembly is provided that is used to urge the apparatus into a position of mating and which automatically increases the strain relief that is provided whenever slack develops by the use of a plurality of fingers and tapered ratcheting teeth. Various methods of reducing shear intermediate the pair of body housings are disclosed.

13 Claims, 5 Drawing Sheets

EXPLODED VIEW OF 10

SECTION 2-2

DETAIL OF 50

DETAIL OF 34

DETAIL OF 56

DETAIL A

FIELD ATTACHABLE ELECTRICAL CONNECTOR AND SELF-TIGHTENING METHOD OF STRAIN RELIEF

BACKGROUND OF THE INVENTION

1. Field of the Invention

The present invention, in general, relates to electrical connectors and, more particularly, to electrical connectors that are used to supply electrical power to an aircraft and which are field-replaceable.

In order to energize the electrical systems of an aircraft without running a generator on-board the aircraft, an electrical cable is used to supply 400 Hz electrical power to the aircraft. Typically, the electrical power that is supplied is three phase and is at approximately 200 volts (AC).

The mating interface on the plug on the end of the cable which mates to the aircraft is standardized by adherence to U.S. Military Specification MIL-C7974.

Switches are sometimes installed in the connector plug and are used to actuate a device to extend or retract additional lengths of cable off of a spool or to cycle power to the aircraft through the cable at appropriate times. For example, it is not appropriate to supply electrical power the moment an electrical connection is made because this can damage the electrical contacts.

Similarly, it is not appropriate to use physical disengagement of the connector as a means of withdrawing electrical power from the aircraft. As is well known in the electrical arts, this will cause arcing to occur and will in turn damage the electrical contacts.

A plurality of switches (typically up to four switches) and a plurality of lights (to indicate switch function, power status, or other) may optionally be included in these and various types of connectors.

To cycle power, "on" and "off" switches are used to energize and de-energize a relay at the source of electrical power on the ground. The "on" switch can then be depressed to energize power to the aircraft only after the connector is properly mated to the aircraft and, conversely, the "off" switch can be depressed to de-energize electrical power before any attempt is made to remove the connector from the aircraft.

The on and off switches are optional in these types of connectors. The use of a recessed contact is also generally used in these types of connectors to prevent the application of electrical power to the aircraft until a sufficiency of mating amongst the contacts that actually supply electrical power to the aircraft has first been accomplished.

However, the defect to this purely mechanical approach to regulating the application of electrical power to the aircraft is that if a person abruptly jerks the connector apart from the aircraft, there remains the potential for damage to occur to the contacts as a result of the subsequent arcing that is likely to occur.

The other common types of switches are typically labeled "in" and "out". When the "in" switch is depressed, the spool will wind in such a direction so as to retract the cable and when the "out" switch is depressed, the spool will unwind and spool out additional cable to reach the aircraft. A cable hoist is often used in place of a spool, with the same effects.

Often, the plug that is disposed at the end of the electrical cable is molded (i.e., it is made of a type of rubber) and it is permanently attached to the cable by the manufacturer. Therefore, it cannot be replaced in the field. A molded plug that is durable and can be replaced in the field is desirable.

It is far more likely that defects will arise in or proximate the connector than elsewhere in the cable itself. Obviously, if a defect should arise in the connector, it is advantageous to be able to replace the connector instead of the entire cable. Such a connector is known in the arts as one that is "field attachable" or "field replaceable".

It is known according to the present state of the art to utilize a replaceable contact section, sometimes called a "nose", as is disclosed in U.S. Pat. No. 4,758,175 and which is incorporated by reference herein. This permits the end user to replace this portion of the connector when needed due to abrasion or other types of damage that may occur.

The preceeding type of nose is typically attached to a another component, a nose insert that is surrounded by a split two-part plastic body housing which is filled with epoxy that is allowed to flow into the housing through the switch hole(s). There are problems associated with this approach.

The first is that the two-part plastic body housing does not provide an adequate seal to prevent epoxy from leaking out. While not posing a problem in performance, this is undesirable from an aesthetic point of view.

Also, the plastic that the body housing is made of tends itself to loosen and wear over the course of time. As such, it may develop slack. A strain relief is typically added as well and it serves to limit the bend radius.

A maintenance schedule may be established to periodically tighten any clamps or screws and to take up slack that may develop (due to a general loosening or wear).

However, there is no way to really know if any established maintenance schedule is correct. If maintenance is done too often, there is an excess of labor. If it is not done often enough, the result is ineffective strain relief and premature wear and failure. Without adequate strain relief when removing the cable from the aircraft, the person may be pulling on the individual conductors, rather than on the jacket and connector. This can cause premature wear and conductor failure to occur.

Also, due to size constraints, the plastic body housing is thin and the two halves may move in shear with respect to one-another. The two halves may also tend to separate and, as mentioned hereinabove, epoxy may tend to leak out before it has fully set.

The epoxy potting is necessary in order to meet the required specifications and also to provide the durability that is needed. These connectors may, for example, be dropped, dragged, or run over by machinery that is being operated nearby (e.g., ramp tractors). Therefore, the connectors must be resistant to crushing and also to other types of severe loading that they may experience.

Also, when these connectors are inserted (or withdrawn), a great deal of force is typically required, a force that is normally measured in the "tens" of pounds. The force to insert the connector into the aircraft can even approach or exceed one-hundred pounds of force. Field personnel expect this and it is not an issue other than to note that these connectors are subject to substantial forces that occur during their insertion and removal.

The aforementioned problems and requirements for connecting power to an aircraft tend to be extreme and therefore are poised to maximally benefit from the instant disclosure. However, the invention is applicable, as desired, for use in various applications other than those involving aircraft. In general, wherever a durable field replaceable type of a connector is required, the benefits and uses as disclosed herein, apply.

Accordingly there exists today a need for a field attachable electrical connector & self-tightening method of strain relief that helps to reduce the aforementioned problems.

Clearly, such an apparatus would provide a useful and desirable device and method.

2. Description of Prior Art

Electrical connectors are, in general, known. While the structural arrangements of the known types of devices, at first appearance, may have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a field attachable electrical connector that can be replaced in the field.

It is also an important object of the invention to provide a field attachable electrical connector that is durable.

Another object of the invention is to provide a field attachable electrical connector that includes means for resisting motion between two halves of a body housing in shear.

Still another object of the invention is to provide a field attachable electrical connector that includes means for resisting separation from occurring between two halves of a body housing.

Still yet another object of the invention is to provide a field attachable electrical connector that provides a method for adjusting the amount of strain relief automatically during normal use.

Yet another important object of the invention is to provide a field attachable electrical connector & self-tightening method of strain relief that uses the force that is required to insert the connector into the aircraft to automatically take up (i.e., compensate) for any slack that may have occurred over time and use.

Still yet another important object of the invention is to provide a field attachable electrical connector & self-tightening method of strain relief that is adapted to satisfy the requirements of U.S. Military Specification "MIL-C-7974".

Briefly, a field attachable electrical connector & self-tightening method of strain relief that is constructed in accordance with the principles of the present invention has a split plastic body housing consisting of two halves that includes a pair of retaining grooves on each of the two halves, the retaining grooves being adapted to fill with epoxy and to retain the two halves adjacent to each other. A plurality of pins on one of the halves fits into a plurality of holes on the remaining one of the halves when the two halves are adjoined, thereby reducing shear. The body housing is adapted to contain a plastic nose insert, an elastomeric nose, a plurality of crimp contacts, a plurality of switches and lights, and the necessary wiring. When the two halves are properly oriented adjacent to each other, a distal end of each of the two halves that is disposed opposite to that where the elastomeric nose is disposed includes a ratcheting cable retention system. The ratcheting cable retention system provides automatic adjustment of a strain relief that passes over the cable. The strain relief is pressed over a plurality of fingers that are attached to the two halves of the body housing. The strain relief thereby serves to retain the distal ends adjacent to each other. Furthermore, the strain relief cooperates with a tapered ratcheting system on the fingers so that when the connector is pushed into the aircraft the strain relief is grasped and is used to push the connector into mating with the aircraft. Any slack that may have developed over time between the fingers and the cable that is disposed under the fingers is automatically removed by the strain relief being urged closer to the two body halves, thereby tightening the fingers against the cable.

DETAILED DESCRIPTION OF THE INVENTION

Figure 4:
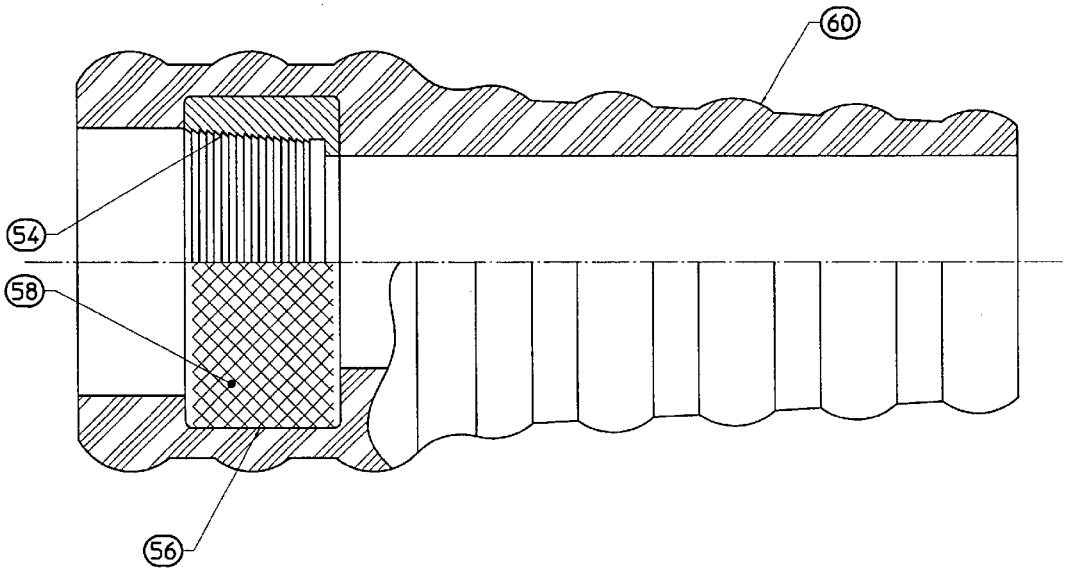
FIG. 4 is a partial cross-sectional view of the strain relief of FIG. 1.
Figure 5:
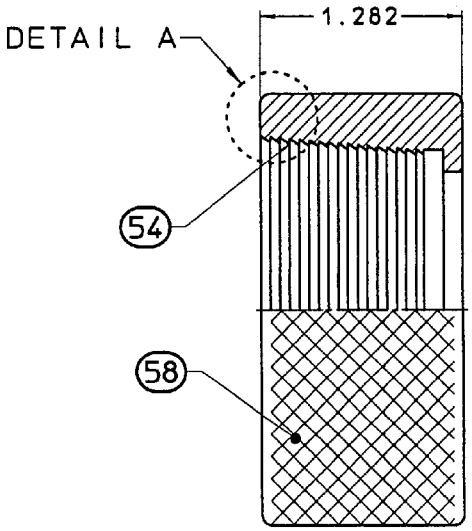
FIG. 5 is a partial cross-sectional view of the compression ring of FIG. 4 with typical dimensions.
Figure 6:
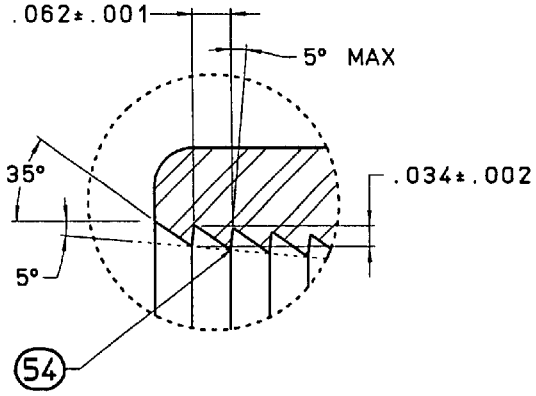
FIG. 6 is an enlarged cross-sectional view of "Detail A" of FIG. 5.

Referring on occasion to all of the FIGURE drawings and now in particular to FIG. 4 is shown, a field attachable electrical connector & self-tightening method of strain relief, identified in general by the reference numeral 10.

A first half of a body housing 12 mates with a second half of a body housing 14. The first and second halves of the body housing 12, 14 are typically formed of a suitable plastic.

The first and second halves of the body housing 12, 14 are preferably identical in construction (to minimize the number of different component parts) and, as shown, are rotated 180 degrees about a center longitudinal axis.

A nose insert 16 is also typically formed of a suitable plastic. The nose insert 16 partially fits into a first end 18 of nose 20 as shown by arrow 21. The nose 20 is preferably formed of an elastomer, such as rubber.

A plurality of crimp contacts 22 (only one is shown) of various sizes are used. The crimp contacts 22 are normally formed of copper.

Each of the crimp contacts 22 are normally crimped onto an end of each appropriate conductor by a standard crimping operation, as is well known in the arts. Then they are each inserted into the back of the nose insert 16, as shown by arrow 24.

The elastomeric nose 20 is secured to the nose insert 16 by sealing screws 104 (typical) that enter in through certain of the holes on a side opposite the first end 18 of the nose 20. The sealing screws then engage threads in the bottom of each of the crimp contacts 22.

The sealing screws each include an elastomeric seal under the screw head and therefore also provide a water barrier as well as securing the nose 20 to the nose insert 16.

The first half of the body housing 12 includes a plurality of first pins 26 that protrude from one end thereof and which each enter into one of a plurality of first holes 28 on the second half of the body housing 14.

The second half of the body housing 14, on a side opposite that of where the first holes 28 are disposed, includes a plurality of second pins 30. The second pins 30 are similarly to the first pins 26. The second pins 30 each enter into one of a plurality of second holes 32 that are included on the first half of the body housing 12.

When the first and second halves 12, 14 are assembled together, the first and second pins 26, 30 and the first and second holes 28, 32 cooperate to provide resistance to shear from occurring between the two halves 12, 14 as well as providing a tight fit and proper alignment of each of the halves 12, 14 along a perimeter thereof with respect to each other.

The first and second halves 12, 14 are assembled in a "clamshell" configuration around a cable (not shown). The cable includes a cable jacket which surrounds the cable (i.e., wire) conductors.

The cable and cable jacket pass through a strain relief assembly 34. The strain relief assembly 34 is described in greater detail hereinafter. The conductors of the cable are each attached to one of the crimp contacts 22, as was described hereinabove.

Certain of the conductors that are provided in the cable are attached to lights and switches (not shown) that were described hereinabove in the "BACKGROUND OF THE INVENTION" section.

The lights and switches are each attached to the first and second halves 12, 14 through a plurality of accessory mounting holes 36. The accessory mounting holes 36 may include "knockouts" that are removed, as desired, to accommodate any of the lights and switches.

Each of the pair of protrusions 38 includes a threaded insert that is adapted to receive a mounting screw 100 that passes through a washer 102 first and then a hole provided in each of the corresponding recesses 40. The mounting screws secure the first and second halves 12, 14 to the nose insert 16 and also retain the first and second halves 12, 14 adjacent to each other.

Both of the pairs of protrusions 38, the recesses 40, and the mounting screws cooperate together thereby serving to provide resistance to shear proximate the nose insert 16.

Figure 1:
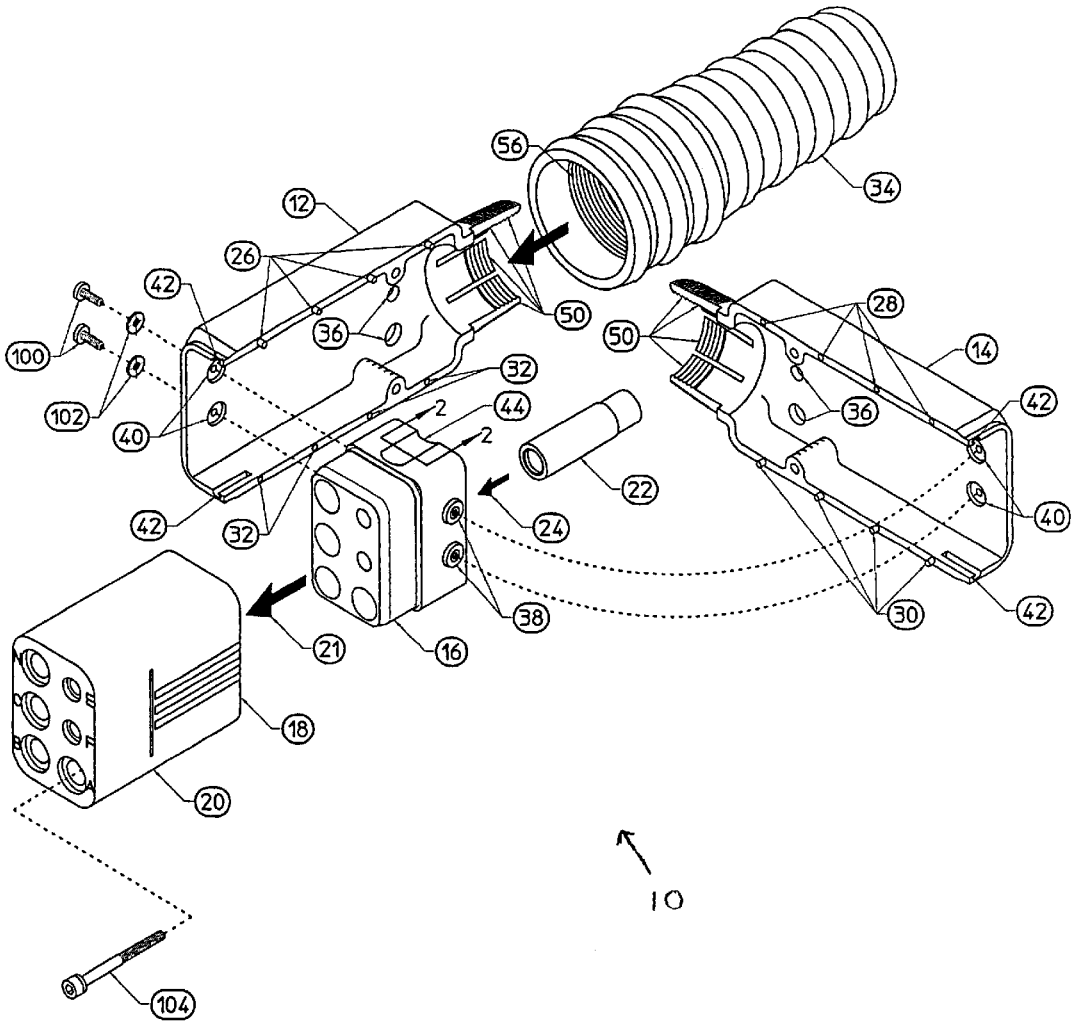
FIG. 1 is an exploded view in perspective of the field attachable electrical connector & self-tightening method of strain relief.
Figure 2:
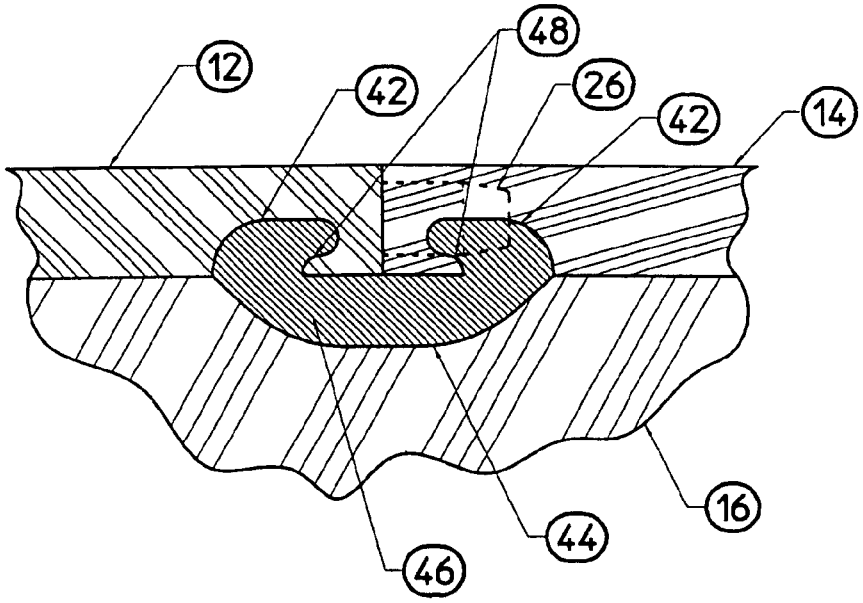
FIG. 2 is an enlarged cross sectional view taken along the line 2—2 in FIG. 1, except that the two halves of the body housing are shown together in this view.
Figure 3:
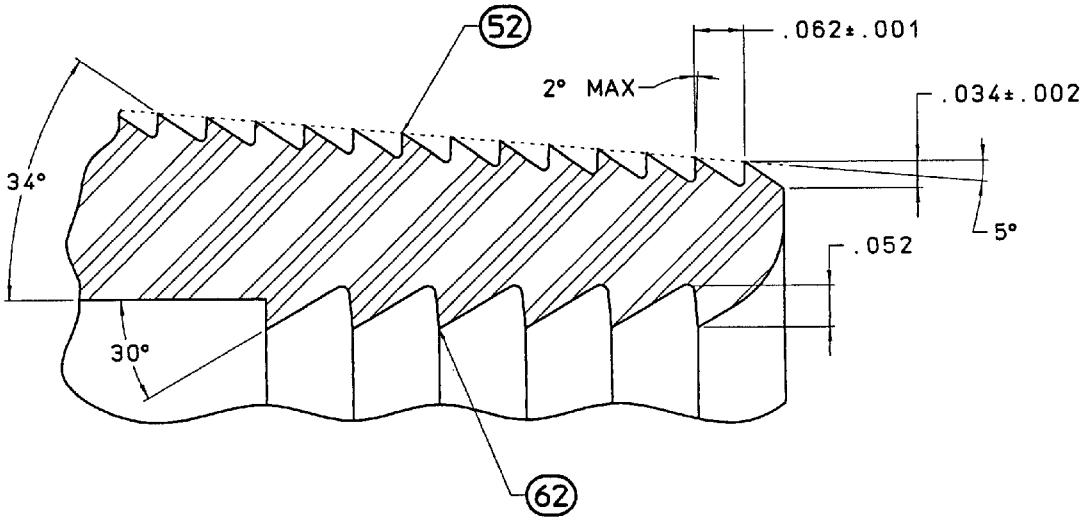
FIG. 3 is an enlarged cross-sectional view of a portion of one of the fingers as shown in FIG. 1 with typical dimensions.

Referring now also to FIG. 2, a retaining groove 42 is disposed on each end of each of the first and second halves 12, 14. A larger groove 44 is provided on each end of the nose insert 16.

After the connector 10 is assembled, an epoxy potting compound 46 is poured in through one or more of the accessory mounting holes 36 and is allowed to harden (typically overnight) before the connector 10 is used.

The epoxy potting compound 46 passes around a pair of arcuate terminations 48 (i.e., lips) in each of the retaining grooves 42 and forms a generally "C" shaped cross section of the epoxy potting compound 46 that, when hardened, resists separation of the two halves 12, 14 in this area.

During assembly of the connector 10, the strain relief assembly 34 is slid in a first direction along a longitudinal axis of the cable. The strain relief assembly 34 is urged in the first direction over the cable and it is forced over a plurality of fingers 50, to which it is secured by a plurality of first ratcheting teeth 52 on the fingers and a plurality of corresponding second ratcheting teeth 54 on a circular metallic insert 56 that is molded into the strain relief assembly 34.

Accordingly, the strain relief assembly 34 is adapted for longitudinal movement in the first direction but is prevented from longitudinal movement in a direction that is opposite that of the first direction. See also FIG. 3 through FIG. 6 inclusive.

The metallic insert 56 is preferably formed of an aluminum alloy and it preferably includes a diamond knurl finish 58.

A contoured and tapered casing 60 is formed of an elastomer (i.e., rubber) and is molded around the metallic insert 56. As the cross-sectional view of FIG. 4 shows, the metallic insert 56 is solidly embedded in the casing 60 and would resist any longitudinal displacement with respect to the casing 60. The diamond knurl finish 58 further serves to secure the metallic insert 56 to the casing 60.

The casing 60 provides a gradual bend radius which protects the cable from being bent at too sharp of an angle proximate the connector 10.

The casing 60 also allows for a comfortable grip and it is used to push the connector 10 into a mating position with a corresponding connector half (not shown) that is typically disposed on an aircraft frame (not shown).

During initial assembly of the connector 10, the casing 60 is forced over the fingers 50 with a sufficient force so as to cause each of the fingers to bend in toward the cable.

Each of the fingers 50 includes on an inside radius thereof, a plurality of gripping teeth 62. When the casing 60 is urged toward the connector 10, the metallic insert 56 is forced over the fingers 50.

As the decreasing taper of the second ratcheting teeth 54 of the metallic insert 56 are forced over the first ratcheting teeth 52 of the fingers 50, the overall outside diameter of the plurality of fingers 50 is progressively reduced.

The gripping teeth 62, in turn, are urged to increasingly bite into the cable jacket thereby serving to secure the connector 10 to the cable and providing improved strain relief functioning. When sufficient force is applied to the casing 60 the gripping teeth 62 will be urged into optimum contact with the cable jacket.

When the casing 60 is then used to urge (i.e., push) the connector 10 into the aircraft, the force that is applied to the casing 60 is evenly distributed through the connector 10 and the cable jacket. This prevents the application of an excessive force directly to the individual wire conductors that could result in premature failure of the connector 10 or the cable within the connector 10.

Over the course of time and use, it is possible for a mechanically attached strain relief to loosen. Each time the connector 10 is inserted into the aircraft, considerable force is applied to the casing 60 which again tends to urge the casing 60 further toward (and over) the fingers 50.

If sufficient slack has developed so that maintenance (i.e., tightening) of the strain relief assembly 34 is required, this is accomplished automatically and at precisely the proper time when it is needed.

This occurs, substantially unnoticed, in that when adjustment is required, the force that is applied to the casing 60 when the connector 10 is being inserted into the aircraft will cause the second ratcheting teeth 54 on the inside of the metallic insert 56 to pass over one, or possibly two, more of the first ratcheting teeth 52 of the fingers 52. This, in turn, further urges the gripping teeth 62 to bite (clamp) down onto the cable jacket.

Accordingly, the need to periodically tighten (i.e., maintain) the strain relief assembly 34 is eliminated as a separate task because it is automatically accomplished whenever it is required simply during normal use (i.e., insertion) of the connector 10. Optimum levels of strain relief are always provided without the need for additional maintenance.

Over the useful life of the connector 10, only a small amount of displacement (in the first direction) of the strain relief assembly 34 will occur or is needed to ensure a proper level of strain relief.

Replacement of the field attachable electrical connector 10 is accomplished by cutting the old connector 10 off of the cable and stripping the conductors (as is well known in the arts) of the cable and by repeating the assembly process as described hereinabove with a new connector 10.

Lastly, a new quantity of the epoxy potting compound 46 is then poured into the new connector 10 to fill the voids and recesses therein and it is allowed to harden prior to using the new connector 10.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A field attachable electrical connector, comprising:

(a) a housing, said housing adapted to receive a cable therein, said cable including at least one electrical conductor therein;

(b) a strain relief attached to said housing and including means for securing said housing to said cable when said strain relief is urged longitudinally toward said housing and without any rotation of said strain relief required to displace said strain relief toward said housing and wherein said electrical connector includes an axis of insertion and wherein said electrical connector is adapted to be urged in a direction that is parallel to said axis of insertion when said electrical connector is mated with a corresponding electrical connector and wherein when said strain relief is urged longitudinally toward said housing, said strain relief is urged in a direction that is parallel with said axis of insertion;

and wherein said housing includes a first half and a second half, wherein said first half is adapted to adjoin said second half when said housing is assembled; and wherein said means for securing said housing to said cable includes a plurality of fingers attached to each of said first and second halves of said housing and a strain relief assembly that is adapted to slide over said plurality of fingers and to displace said fingers toward said cable; and wherein said strain relief assembly is adapted to be grasped and urged in a direction that is parallel with said axis of insertion when said electrical connector is mated with said corresponding electrical connector;

and wherein said plurality of fingers includes a plurality of first ratcheting teeth disposed on an outer circumference of said plurality of fingers and a plurality of corresponding second ratcheting teeth disposed on an inside circumference of a metallic insert disposed in said strain relief assembly, whereby said first ratcheting teeth and said second ratcheting teeth are disposed on a first and said second taper respectively, and wherein when said strain relief assembly is urged toward said connector along said axis of insertion, said second ratcheting teeth incrementally advance over said first ratcheting teeth in a first direction along a longitudinal axis of said cable where said cable is attached to said connector and wherein said first and said second ratcheting teeth cooperate to prevent said strain relief assembly from being urged in a second direction that is opposite to said first direction;

and wherein when strain relief assembly is urged in a direction that is parallel with said axis of insertion an increase in a magnitude of force that is exerted by said plurality of fingers upon said cable is provided when needed by said second ratcheting teeth incrementally advancing over said first ratcheting teeth in said first direction sufficient to automatically maintain a desired level of strain relief by mating said electrical connector with said corresponding electrical connector.

2. The field attachable electrical connector of claim 1 wherein at least one groove is provided in said first half and in said second half and wherein an arcuate lip is provided in each of said grooves in said first half and said second half and wherein a recessed groove is provided in said nose insert proximate each of said grooves when said first half is disposed proximate said second half and wherein a cavity is provided that is adapted to receive a potting epoxy therein and whereby when said potting epoxy is cured said potting epoxy cooperates with said arcuate lips to retain said first half proximate to said second half.

3. The field attachable electrical connector of claim 1 including a nose and a nose insert wherein said nose is secured to said nose insert by at least one screw passing through at least one hole provided in said nose and through said nose insert and being attached to corresponding threads that are disposed in at least one contact that is disposed in said at least one hole and wherein said nose is secured to said nose insert when said at least one screw is tightened.

4. The field attachable electrical connector of claim 3 wherein said nose insert includes a plurality of protrusions that are each adapted to enter into a corresponding recess respectively in each of said first half and said second half of said housing, and wherein each of said protrusions includes a threaded insert therein and wherein each of said corresponding recesses includes a hole therein, said hole adapted to receive a screw therein that is adapted to cooperate with said threaded insert sufficient to secure each of said first and said second halves of said housing to said nose insert.

5. The field attachable electrical connector of claim 1 wherein said housing includes means for providing resistance to shear.

6. The field attachable electrical connector of claim 5 wherein said means for providing resistance to shear includes a plurality of pins disposed in said first half and a plurality of holes disposed in said second half, each of said plurality of pins adapted to enter into one of each of said plurality of holes.

7. The field attachable electrical connector of claim 5 wherein said means for providing resistance to shear includes a plurality of pins disposed in one side of said first half and a plurality of holes disposed in an opposite side of said first half and including a plurality of holes in said second half that are disposed opposite with respect to said plurality of pins in said one side of said first half and including a plurality of pins disposed in an opposite side of said second half, wherein each of said plurality of pins in said first half is adapted to enter into one of each of said plurality of holes in said second half and wherein each of said plurality of pins in said second half is adapted to enter into one of each of said plurality of holes in said first half.

8. The field attachable electrical connector of claim 1 wherein said plurality of fingers are increasingly urged toward said cable when said strain relief assembly is urged in said first direction.

9. The field attachable electrical connector of claim 8 wherein each of said plurality of fingers includes a plurality of gripping teeth that are disposed on an inside circumference thereof and which are adapted to increasingly secure said fingers to said cable when said strain relief assembly is urged in said first direction.

10. The field attachable electrical connector of claim 9 wherein said strain relief assembly is adapted to be urged in said first direction when said connector is inserted into said corresponding mating connector and wherein said force that is applied to said strain relief assembly when said connector is inserted into said corresponding mating connector is sufficient to longitudinally displace said strain relief assembly in said first direction when a sufficient amount of slack develops intermediate said plurality of fingers and said cable, and wherein said displacement in said first direction is adapted to reduce said slack.

11. A method for automatically increasing strain relief applied to a cable of a field attachable electrical connector consisting of the steps of:

(a) providing a housing, said housing adapted to receive a cable therein, said cable including at least one electrical conductor therein;

(b) providing increasing strain relief for securing said housing to said cable when said strain relief is urged longitudinally and without rotation toward said housing and wherein said electrical connector includes an axis of insertion and wherein said electrical connector is adapted to be urged in a direction that is parallel to said axis of insertion when said electrical connector is mated with a corresponding electrical connector and wherein when said strain relief is urged longitudinally toward said housing, said strain relief is urged in a direction that is parallel with said axis of insertion;

and wherein the step of providing said housing includes providing a first half and a second half, wherein said first half is adapted to adjoin said second half when said housing is assembled; and providing a plurality of fingers attached to each of said first and second halves of said housing and providing a strain relief assembly that is adapted to slide over said plurality of fingers and to displace said fingers toward said cable; and wherein said strain relief assembly is adapted to be grasped and urged in a direction that is parallel with said axis of insertion when said electrical connector is mated with said corresponding electrical connector;

and wherein said plurality of fingers includes a plurality of first ratcheting teeth disposed on an outer circumference of said plurality of fingers and a plurality of corresponding second ratcheting teeth disposed on an inside circumference of a metallic insert disposed in said strain relief assembly, whereby said first ratcheting teeth and said second ratcheting teeth are disposed on a first and said second taper respectively, and wherein when said strain relief assembly is urged toward said connector along said axis of insertion, said second ratcheting teeth incrementally advance over said first ratcheting teeth in a first direction along a longitudinal axis of said cable where said cable is attached to said connector and wherein said first and said second ratcheting teeth cooperate to prevent said strain relief assembly from being urged in a second direction that is opposite to said first direction;

and wherein when strain relief assembly is urged in a direction that is parallel with said axis of insertion an increase in a magnitude of force that is exerted by said plurality of fingers upon said cable is provided when needed by said second ratcheting teeth incrementally advancing over said first ratcheting teeth in said first direction sufficient to automatically maintain a desired level of strain relief by mating said electrical connector with said corresponding electrical connector; and (c) urging said strain relief longitudinally toward said housing.

12. The method for automatically increasing strain relief of claim 11 wherein the step of urging said strain relief assembly toward said housing includes the step of grasping said strain relief assembly and applying a force to said strain relief assembly sufficient to urge said connector into said corresponding connector and wherein a force is applied to said strain relief assembly in a direction that urges said strain relief assembly toward said housing when said connector is urged into said corresponding mating connector.

13. A field attachable electrical connector, comprising:

(a) a housing, said housing adapted to receive a cable therein, said cable including at least one electrical conductor therein;

(b) a strain relief attached to said housing and including means for securing said housing to said cable when said strain relief is urged longitudinally toward said housing and without any rotation of said strain relief required to displace said strain relief toward said housing and wherein said electrical connector includes an axis of insertion and wherein said electrical connector is adapted to be urged in a direction that is parallel to said axis of insertion when said electrical connector is mated with a corresponding electrical connector and wherein when said strain relief is urged longitudinally toward said housing, said strain relief is urged in a direction that is parallel with said axis of insertion;

and wherein an increase in a magnitude of force that is exerted by said strain relief upon said cable is provided when said strain relief is urged longitudinally toward said housing, and wherein said strain includes a plurality of fingers attached to said housing and wherein each of said plurality of fingers is separated by a slot therebetween, and wherein said strain relief includes a strain relief assembly that is adapted to be displaced over said plurality of fingers and wherein said plurality of fingers are adapted to be increasingly displaced radially toward said cable subsequent to said strain relief assembly being displaced over said plurality of fingers in a first direction that is toward said corresponding electrical connector and parallel to said axis of insertion, and wherein said plurality of fingers includes a plurality of first ratcheting teeth that are disposed on an outer circumference thereof and a plurality of corresponding second ratcheting teeth that are disposed on an inside circumference of a metallic insert of said strain relief assembly, and wherein said first ratcheting teeth and said second ratcheting teeth are disposed on a first and second taper respectively, and wherein when a force is applied sufficient to urge said strain relief assembly in said first direction, said second ratcheting teeth are adapted to incrementally advance over said first ratcheting teeth an amount that is sufficient to reduce a slack occurring intermediate said plurality of fingers and said cable and to increase a force exerted by said plurality of fingers on said cable;

and wherein said first and said second ratcheting teeth cooperate to prevent said strain relief assembly from being urged in a second direction that is opposite to said first direction.

* * * * *